US005104000A

United States Patent [19]

Goff

[11] Patent Number: 5,104,000

[45] Date of Patent: Apr. 14, 1992

[54] PERMANENT WAVE END PAPER DISPENSER

[76] Inventor: Lois S. Goff, P.O. Box 596, Susanville, Calif. 96130

[21] Appl. No.: 568,772

[22] Filed: Aug. 17, 1990

[51] Int. Cl.[5] ..... B65H 3/02

[52] U.S. Cl. ..... 221/191; 221/259; 221/261; 221/274; 221/276; 221/281

[58] Field of Search ..... 221/191, 197, 208, 210, 221/213, 259, 261, 268, 270–272, 274, 276, 281

[56] References Cited

U.S. PATENT DOCUMENTS

| | | | |
|---|---|---|---|
| 441,620 | 11/1890 | Moodie | 221/213 |
| 930,619 | 8/1909 | Russell | 221/259 |
| 2,702,145 | 2/1955 | Paulas | 221/44 |
| 3,023,931 | 3/1962 | Carlson | 221/44 |
| 4,042,156 | 8/1977 | Knight | 221/309 |
| 4,058,235 | 11/1977 | Cassia . | |
| 4,094,444 | 6/1978 | Willis | 221/266 |
| 4,185,753 | 1/1980 | Leto . | |
| 4,313,601 | 2/1982 | Graef et al. | 271/207 |
| 4,417,670 | 11/1983 | Booher . | |
| 4,592,486 | 6/1986 | Belokin | 221/309 |
| 4,629,092 | 12/1986 | English | 221/247 |
| 4,655.377 | 4/1987 | Orangeo, Jr. et al. . | |
| 4,681,240 | 7/1987 | Wyant . | |
| 4,733,765 | 3/1988 | Watanabe | 221/12 |
| 4,865,223 | 9/1989 | Huang | 221/259 |
| 4,941,591 | 7/1990 | Lin et al. | 221/259 |
| 4,995,602 | 2/1991 | Nakadai et al. | 271/207 |

*Primary Examiner*—H. Grant Skaggs
*Attorney, Agent, or Firm*—Jerry T. Kearns

[57] ABSTRACT

A permanent wave end paper dispenser allows a beauty operator to dispense permanent wave end papers from a housing in a one at a time manner, utilizing only one hand. The dispenser includes a rectangular housing with an inclined ramp disposed adjacent a paper discharger opening formed in a front wall. The ramp has a V-shaped notch to allow an operator to grasp an end paper dispensed through the discharge opening. A paper supply drawer is removably received in a feed opening formed in a back wall of the housing, to allow refilling of the dispenser. A push button on the front wall of the housing is in abutment with a first end of a horizontally disposed plunger rod. The second end of the plunger rod and a first end of a coil spring are connected to a lowermost extension member of a vertically extending rotatable post. A second end of the coil spring is connected to the front housing wall, biasing the post and plunger rod to a return position. A laterally extending control rod has a first end secured to an upper extension member of the post, and a second end received through an elongated slot formed in a mounting block portion of a slider. The slider is received for reciprocal movement along a guide track secured to an interior ceiling of the housing. A swing arm is pivotally secured to the slider, and has a free bottom end portion provided with a rubber paper engaging tip.

13 Claims, 4 Drawing Sheets

PERMANENT WAVE END PAPER DISPENSER

BACKGROUND OF THE INVENTION

1. Field of the Invention

The present invention relates to dispensers, and more particularly pertains to a dispenser for permanent wave end papers. End papers are utilized in conjunction with permanent wave rods during the process of permanently curling an individual's hair. The papers are wound with an individual's hair around the wave rods, and perform the functions of absorbing permanent wave chemical solution, keeping the hair damp with the solution, and providing a protective cushion between the hair and rod. Thus, a beauty operator must constantly reach for and separate a single paper from a stack while rolling the individual's hair. This is an inconvenient and tedious chore, which is exacerbated by the damp hands of the beauty operator, as described in U.S. Pat. No. 4,185,753, the entire disclosure of which is incorporated by reference herein. In order to overcome this problem, the present invention provides a dispenser which allows end papers to be dispensed in a one at a time manner, utilizing only one hand of the beauty operator.

2. Description of the Prior Art

Various types of dispensers are known in the prior art. A typical example of such a dispenser is to be found in U.S. Pat. No. 4,058,235, which issued to A. Cassia on Nov. 15, 1977. This patent discloses a dispenser for interleaved sheets of tissue, and includes an open-top rectangular container having a bottom dispenser opening. U.S. Pat. No. 4,185,753, which issued to M. Leto on Jan. 29, 1980, discloses a permanent wave end paper dispenser attached to a wrist bracelet. Papers are manually pulled through a slot in a triangular housing. U.S. Pat. No. 4,417,670, which issued to H. Booher on Nov. 29, 1983, discloses a dispenser for permanent wave end papers. The device includes a spring biased pivotal pick up head having a tacky adhesive for engagement with the uppermost paper sheet in a stack. U.S. Pat. No. 4,655,377, which issued to J. Orangeo, Jr. et al. on Apr. 7, 1987, discloses a dispenser for permanent wave end paper. A continuous roll of paper is manually pulled through a slit in a rectangular housing. A cutting edge is disposed adjacent the slit for severing the desired length of paper. U.S. Pat. No. 4,681,240, which issued to J. Wyant on Jul. 21, 1987, discloses a dispenser for folded, interleaved paper towels. The towels are pulled manually through a slit in a rectangular housing.

While the above mentioned devices are directed to dispensers, none of these devices utilize a push button in conjunction with a plunger rod, a rotatable post, a control rod, a reciprocal slider and a pivotal paper engaging swing arm to dispense end papers in a one at a time manner through a dispensing opening up an inclined ramp. Inasmuch as the art is relatively crowded with respect to these various types of dispensers, it can be appreciated that there is a continuing need for and interest in improvements to such dispensers, and in this respect, the present invention addresses this need and interest.

SUMMARY OF THE INVENTION

In view of the foregoing disadvantages inherent in the known types of dispensers now present in the prior art, the present invention provides an improved permanent wave end paper dispenser. As such, the general purpose of the present invention, which will be described subsequently in greater detail, is to provide a new and improved permanent wave end paper dispenser which has all the advantages of the prior art dispensers and none of the disadvantages.

To attain this, representative embodiments of the concepts of the present invention are illustrated in the drawings and make use of a permanent wave end paper dispenser which allows a beauty operator to dispense permanent wave end papers from a housing in a one at a time manner, utilizing only one hand. The dispenser includes a rectangular housing having an inclined ramp disposed adjacent a paper discharge opening formed in a front housing wall. The ramp has a V-shaped notch to allow a beauty operator to conveniently grasp an end paper which has been dispensed through the discharge opening. A paper supply drawer is received for sliding movement in a feed opening formed in a back wall of the housing, to allow convenient refilling of the dispenser. A pivotal push button is mounted on the front wall of the housing. An elongated horizontally disposed plunger rod has a first end in abutment with the push button and a second end connected to a vertically extending rotatable post. The vertical post has a pair of vertically spaced lateral extension members. The second end of the plunger rod and a first end of a coil spring are connected to a lowermost one of the extension members. A second end of the coil spring is connected to the front housing wall, and biases the post and plunger rod to a return position. A laterally extending control rod has a first end secured to the upper extension member and a second end received through an elongated slot formed in a mounting block portion of a slider. The slider is received for reciprocal sliding movement between two guide track members secured to an interior ceiling of the housing. A swing arm is pivotally secured to the slider, and has a free bottom end portion provided with a rubber paper engaging tip. In use, a beauty operator depresses the push button, causing linear movement of the plunger rod, rotation of the post and attached control rod, and consequent movement of the slider and swing arm to a rearward position, remote from the discharge opening. The beauty operator then releases the push button, allowing the plunger rod, post, control rod, slider and swing arm to return under the bias of the coil spring. During this return movement, the rubber tip portion of the swing arm engages the uppermost paper in the supply drawer, and pushes it forwardly through the discharge opening and up the inclined ramp. The beauty operator then grasps the dispensed paper between thumb and forefinger for normal usage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. I this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved permanent wave end paper dispenser which has all the advantages of the prior art dispensers and none of the disadvantages.

It is another object of the present invention to provide a new and improved permanent wave end paper dispenser which may be easily and efficiently manufactured and marketed.

It is a further object of the present invention to provide a new and improved permanent wave end paper dispenser which is of a durable and reliable construction.

An even further object of the present invention is to provide a new and improved permanent wave end paper dispenser which is susceptible of a low cost of manufacture with regard to both materials and labor, and which accordingly is then susceptible of low prices of sale to the consuming public, thereby making such dispensers economically available to the buying public.

Still yet another object of the present invention is to provide a new and improved permanent wave end paper dispenser which provides in the apparatuses and methods of the prior art some of the advantages thereof, while simultaneously overcoming some of the disadvantages normally associated therewith.

Still another object of the present invention is to provide a new and improved permanent wave end paper dispenser which allows papers to be dispensed from a stack in a one at a time manner.

Yet another object of the present invention is to provide a new and improved permanent wave end paper dispenser which allows papers to be dispensed from a stack in a one at a time manner, utilizing only one hand of an operator.

Even still another object of the present invention is to provide a new and improved permanent wave end paper dispenser which allows papers to be dispensed from a stack without contaminating remaining papers in the stack.

An additional object of the present invention is to provide a new and improved permanent wave end paper dispenser which can be utilized, with equal ease, by either left or right handed individuals.

An additional object of the present invention is to provide a new and improved permanent wave end paper dispenser which is easily refillable.

An additional object of the present invention is to provide a new and improved permanent wave end paper dispenser for storing a supply of end papers in a protected environment, ready for immediate use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
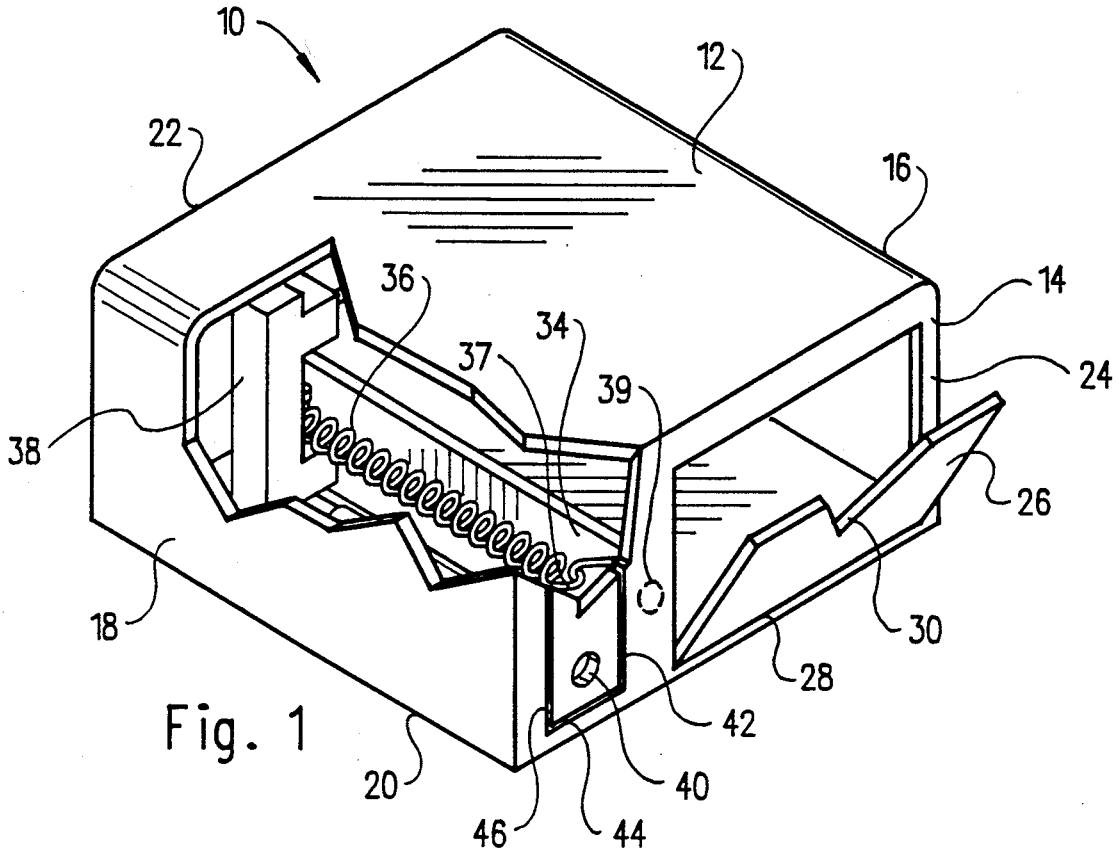
FIG. 1 is a partially cut-away perspective view of the permanent wave end paper dispenser according to the present invention.

With reference now to the drawings, and in particular to FIG. 1 thereof, a new and improved permanent wave end paper dispenser embodying the principles and concepts of the present invention and generally designated by the reference numeral 10 will be described.

Figure 5:
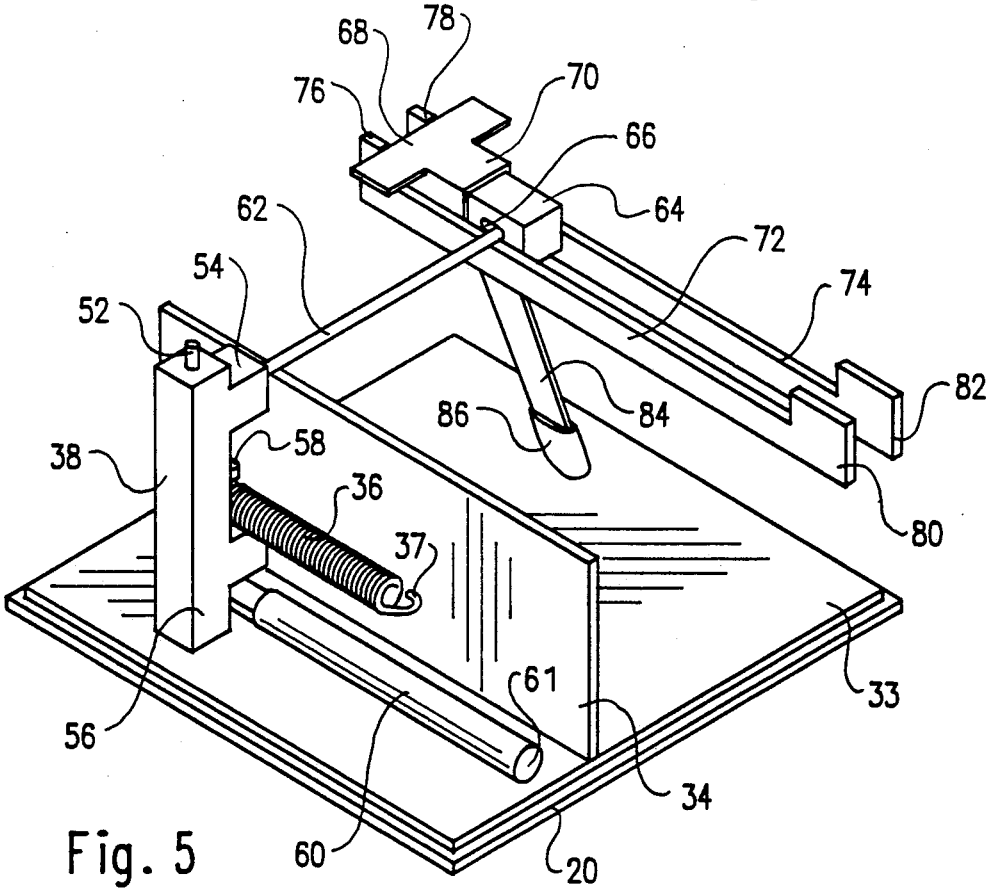
FIG. 5 is a perspective view illustrating the interior components of the dispensing mechanism of the permanent wave end paper dispenser of the present invention.

More specifically, it will be noted that the first embodiment 10 of the invention includes a generally rectangular hollow housing having top 12, front 14, right 16, left 18, bottom 20, and back 22 walls. The dispenser housing includes an inclined ramp 26 connected to the housing along a bottom edge 28 disposed adjacent a paper discharge opening 24 formed in the front housing wall 14. The ramp has a V-shaped notch 30 to allow a beauty operator to conveniently grasp an end paper which has been dispensed through the discharge opening 24. A partition 34 extends within the housing, between the front 14 and back 22 walls. The partition 34 extends vertically upwardly from the interior surface of the bottom wall 20, toward the interior surface of the top wall 12. A coil spring 36 has one end 37 secured to a hook 39 attached to the interior surface of the front wall 14. A vertically extending rotatable post 38 extends between the interior surfaces of the bottom 20 and top 12 walls. An aperture 40 is formed through the front wall 14 of the housing, for receiving an outer end 61 of an elongated generally cylindrical plunger rod 60 (FIG. 5). Vertical slots 42 and 46 are joined at their bottom ends by a transverse slot 44.

Figure 2:
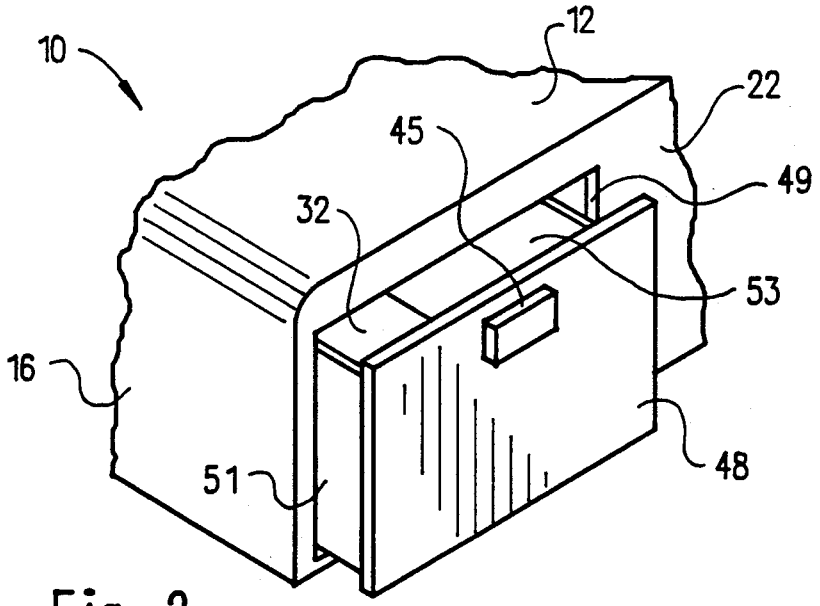
FIG. 2 is a partial perspective detail view illustrating the paper supply drawer of the permanent wave end paper dispenser of the present invention.

As shown in FIG. 2, a paper supply drawer 48 is received for sliding movement in a feed opening 49 formed in the back wall 22 of the housing, to allow convenient refilling of the dispenser. The inner end of the drawer 48, disposed within the dispenser 10, is open to allow forward sliding movement of the paper sheets through the discharge opening 24 (FIG. 1). A rotatable latch 45 is provided on the outer surface of the door 48, to secure the drawer in a closed position and also facilitate opening. The paper supply drawer 48 has opposite side walls 51, 53 connected by a floor 32. In use, a stack of permanent wave end papers are placed in the drawer 48, on the floor 32, prior to insertion of the drawer 48 in the opening 49.

Figure 3:
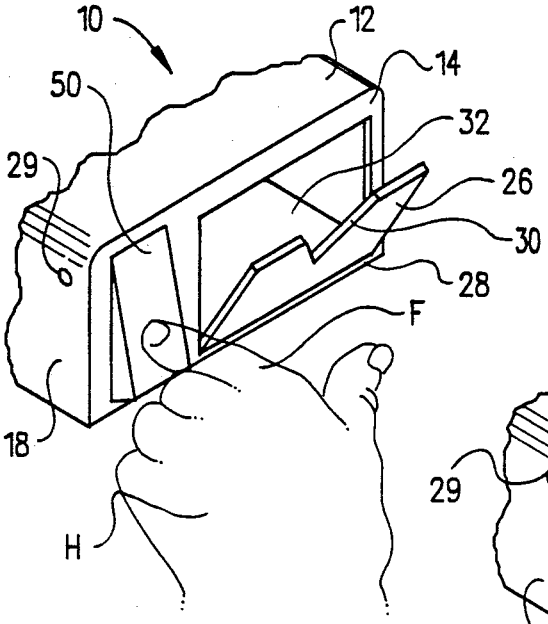
FIG. 3 is a partial perspective detail view illustrating the manner of operation of the permanent wave end paper dispenser of the present invention.

FIG. 3 illustrates a pivotal push button 50 mounted on the front wall of the housing by a pivot pin 29. The push button 50 has inwardly extending flange portions which are received for sliding movement into and out of the slots 42, 44, 46 shown in FIG. 1, thus forming a rearwardly directed recess which receives the outer end 61 of the plunger rod 60 (FIG. 5). In use a beauty operator depresses the button 50 with the finger F of either hand H, and then releases the button 50, which activates the dispensing mechanism (to be described subsequently) to dispense the top paper sheet in a stack situated on the floor 32 of the paper supply drawer 48 (FIG. 2).

Figure 4:
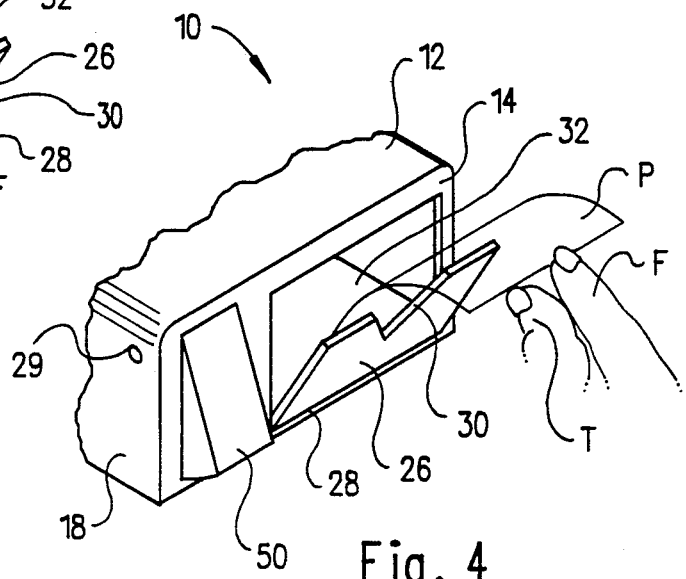
FIG. 4 is a partial perspective detail view further illustrating the manner of operation of the permanent wave end paper dispenser of the present invention.

As shown in FIG. 4, the paper sheet P is pushed outwardly onto the inclined ramp 26, such that an edge of the paper P is exposed within the V-shaped notch 30, where it can be conveniently grasped between the thumb T and finger F of the beauty operator.

FIG. 5 illustrates the construction of the internal components of the dispensing mechanism. An elongated horizontally disposed plunger rod 60 has a first outer end 61 which extends through aperture 40 (FIG. 1) into abutment with push button 50 (FIG. 3). A vertically extending rotatable post 38 has an axle 52 which projects slightly from top and bottom ends of the post 38. The projecting ends of the axle 52 are received for rotation in suitably dimensioned cylindrical recesses formed in the interior surfaces of the top 12 (FIG. 1) and bottom 20 housing walls. Alternatively, the axle 52 may be received for rotation within a bore formed through the post 38, and have top and bottom ends secured to the housing. In either case, the post 38 is mounted for rotation about the longitudinal axis of the axle 52. The vertical post 38 has a pair of vertically spaced lateral extension members 54 and 56. The second end of the plunger rod 60 and a first inner end of the coil spring 36 are connected to the lowermost extension member 56 by a mounting screw 58. A second outer end 37 of the coil spring is connected to the front housing wall by a hook 39 (FIG. 1), thus biasing the post 38 and plunger rod 60 to a return position. A laterally extending control rod 62 has a first end secured to the upper extension member 54 and a second end received through an elongated slot 66 formed in a mounting block portion 64 of a slider 70. The slider 70 is received for reciprocal sliding movement between two guide track members 72, 74 secured to an interior surface of the top wall 12 (FIG. 1) of the housing. Mounting tabs 76, 78, 80, 82 extend perpendicularly upwardly from the respective guide track members 72, 74, and are secured in spaced parallel alignment to the interior surface of the top wall 12 of the housing. The slider 70 has a laterally projecting support arm 68 which is received with clearance in the space between the upper surfaces of the guide tracks 72, 74 and the interior surface of the top wall 12. Thus, the slider 70 and attached mounting block 64 are constrained for linear movement along the guide track members 72, 74. A swing arm 84 is pivotally secured to the slider 70, and has a free bottom end portion provided with a radiused rubber paper engaging tip 86. In an assembled condition, the paper supply drawer is supported on the interior housing surface portion 34, one the side of the partition 34 remote from the post 38. In use, a beauty operator depresses the push button 50 (FIG. 3), causing linear movement of the plunger rod 60, rotation of the post 38 and attached control rod 62, and consequent movement of the mounting block 64, slider 70 and swing arm 84 to a rearward position, remote from the discharge opening 24 (FIG. 1). The beauty operator then releases the push button, allowing the plunger rod 60, post 38, control rod 62, mounting block 64, slider 70 and swing arm 84 to return under the bias of the coil spring 36. During this return movement, the rubber tip portion of the swing arm engages the uppermost paper in the supply drawer 48 (FIG. 2), and pushes it forwardly through the discharge opening 24 and up the inclined ramp 26 (FIG. 4). The beauty operator then grasps the dispensed paper between thumb T and forefinger F for normal usage.

Figure 6:
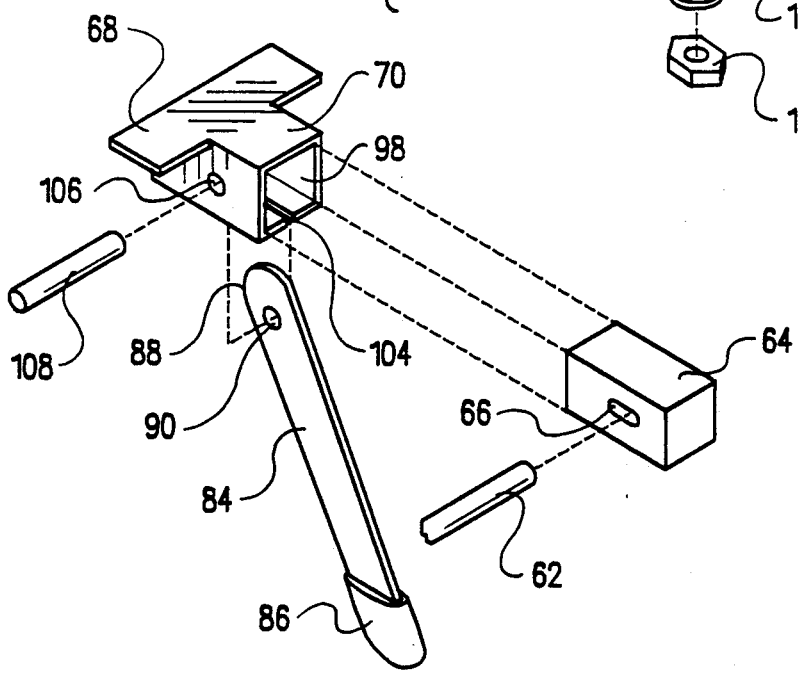
FIG. 6 is an exploded perspective detail view illustrating the slider and paper engaging swing arm portions of the dispensing mechanism of the permanent wave end paper of the present invention.

As shown in FIG. 6, the swing arm 84 has a circular aperture 90 formed adjacent a radiused upper end 88. The upper end 88 is received with clearance through a slot 104 formed in the bottom of the slider 70. A pivot pin 108 extends through the a transverse bore 104 formed through the slider 70. The pin 108 extends with clearance through the aperture 90, thus pivotally mounting the upper end 88 of the swing arm 84 within a hollow interior portion 98 of the slider 70. The mounting block 64 is rigidly secured to the slider 70, and includes an elongated slot 66 which extends laterally entirely therethrough. The free end of the control rod 62 is loosely captured within the slot 66, but is free to slide laterally, transverse to the movement of the slider 70 and block 64, to compensate for the transverse component of the arcuate motion of the control rod 62 with the post 38.

Figure 7:
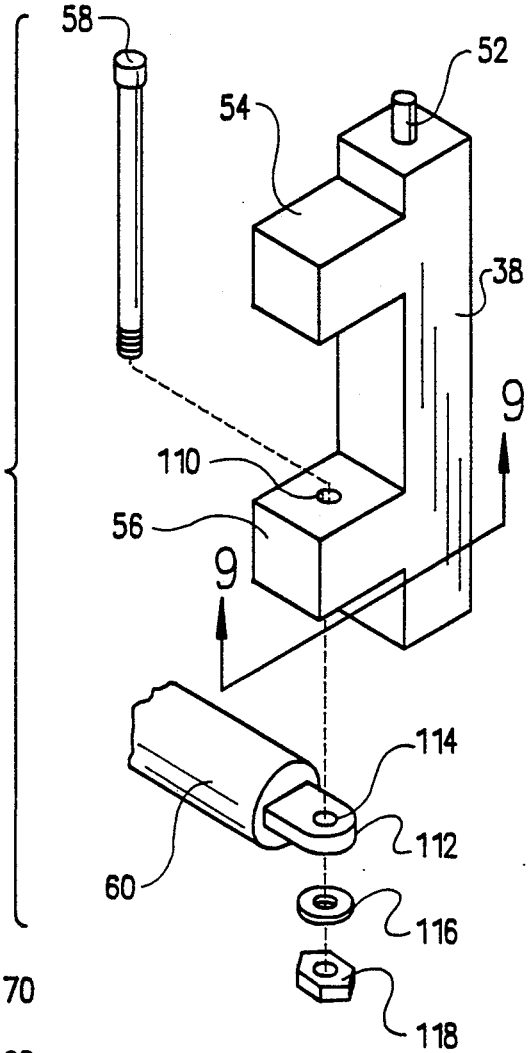
FIG. 7 is an exploded perspective detail view illustrating the connection of the plunger rod with the rotatable post of the dispensing mechanism of the permanent wave end paper dispenser of the present invention.

FIG. 7 illustrates the securement of the tab end portion 112 of the plunger rod 60 to the lower extension member 56 of the post 38, by mounting screw 58, washer 116 and nut 118. The aperture 114 formed through the mounting tab 112 is oversize, thus allowing slight relative pivotal motion of the plunger tab 112 with respect to the post 38. The upper portion of the mounting screw 58 extends sufficiently above the top surface of the extension member 56 to allow attachment of the spring 36 (FIG. 5). The lower portion of the mounting screw 58 is in threaded engagement with both the extension member 56 and the nut 118.

Figure 8:
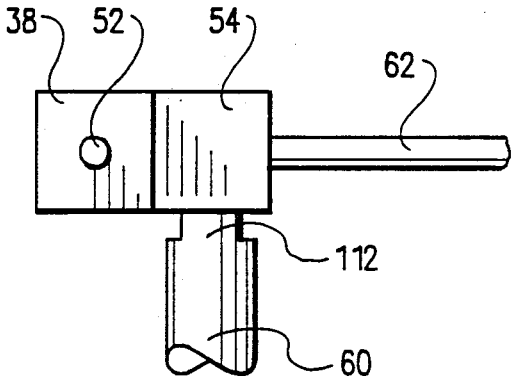
FIG. 8 is a partial top plan detail view illustrating the structural relationship of the plunger rod, rotatable post and control rod of the dispensing mechanism of the permanent wave end paper dispenser of the present invention.

FIG. 8 illustrates the plunger 60, post 58 and control rod 62 in the forward return position, prior to depression of the push button 50 (FIG. 3).

Figure 9:
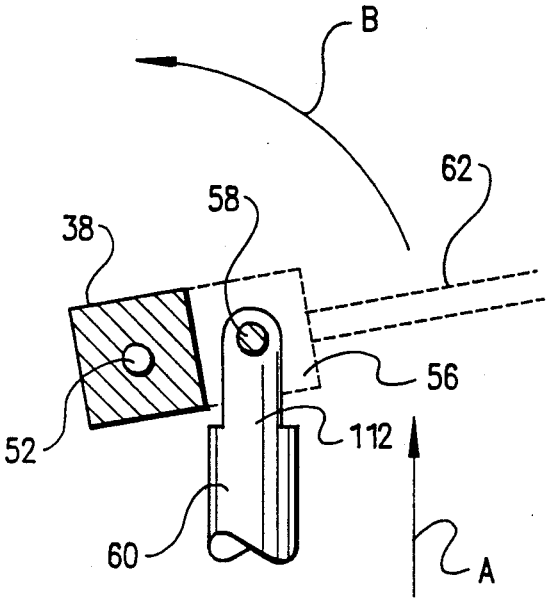
FIG. 9 is a partial cross sectional detail view, taken along line 9—9 of FIG. 7, illustrating the relative movement of the plunger rod, rotatable post and control rod, during operation of the dispensing mechanism of the permanent wave end paper dispenser of the present invention.

FIG. 9 illustrates the rearward movement of the plunger 60 in the direction indicated by arrow A, caused by manual depression of the push button 50 (FIG. 3). The axial motion A of the plunger rod 60 causes rotation of the post 38 and control rod 62 about the axis of the axle 52, as indicated by arrow B. The lateral component (perpendicular to direction A) of the arcuate motion B is compensated for by relative rotation of the mounting screw 28 within the aperture 114 formed in the tab 112, and by lateral sliding of the rod 62 within the slot 66 formed in the mounting block 64 (FIG. 5).

Figure 10:
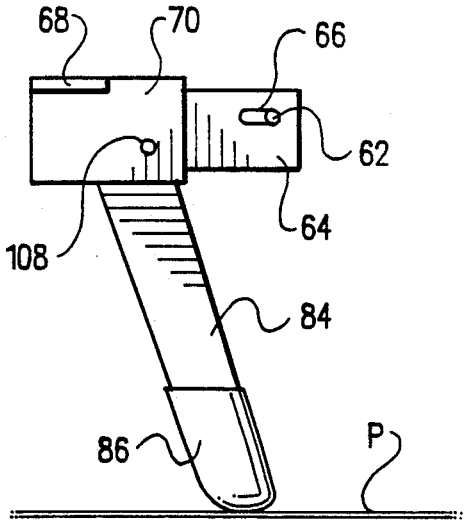
FIG. 10 is a partial side elevational detail view illustrating the slider, control rod and paper engaging swing arm portions of the dispensing mechanism of the permanent wave end paper dispenser of the present invention, in a paper engaging orientation.

FIG. 10 illustrates the rubber tip 86 of the swing arm 84 in a forward return paper engaging position. Note that the control rod 62 is in the forward (toward the discharge opening 24, FIG. 1) position within the slot 66. The length and weight of the arm 84, the rubber tip 86 and the axial constraint of the pivot pin 108 maintains frictional engagement of the swing arm 84 with the top sheet P in the paper stack.

Figure 11:
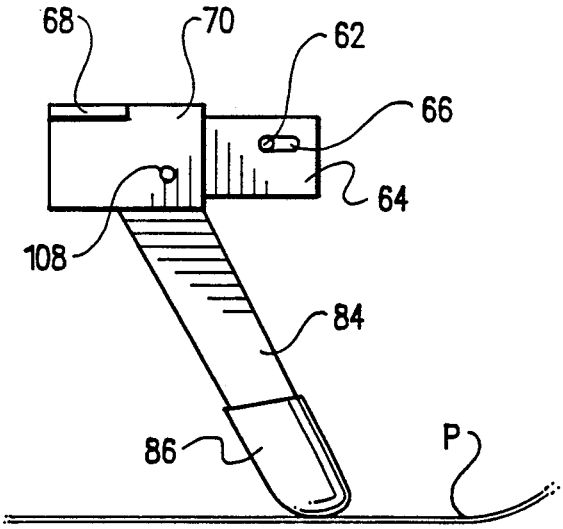
FIG. 11 is a partial side elevational detail view illustrating the slider, control rod and paper engaging swing arm portions of the dispensing mechanism of the permanent wave end paper dispenser of the present invention, in a disengaged orientation.

FIG. 11 illustrates the slider and swing arm assembly in the process of moving toward a rearward position, upon partial depression of the push button 50 (FIG. 3). The control rod 62 is disposed in the rearward (away from the discharge opening 24, FIG. 1) position within the slot 66. During this rearward motion, the swing arm 84 is free to rotate slightly in a counterclockwise direction about the axis of the pivot pin 108, thus allowing the rubber tip 86 to slide freely along the top sheet P in the paper stack. The paper stack will also be constrained against rearward motion by contact with the interior surface of the outer face of the drawer 48 (FIG. 2).

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A permanent wave end paper dispenser, comprising:

a housing;

a discharge opening in said housing;

a paper supply drawer removably received through an opening in said housing for supporting a stack of papers in said housing;

a pivotal swing arm;

a slider;

means pivotally securing said slider to an upper end of said swing arm;

an elongated stationary guide track constraining said slider to reciprocal linear movement along and parallel with said guide track in a single plane across said stack of papers, toward and away from said discharge opening;

means operably connected to said slider for moving said slider along said guide track in a first direction and for moving said swing arm across said stack of papers, toward said discharge opening;

means operably connected to said slider for moving said slider along said guide track in a second direction opposite to said first direction and for moving said swing arm across said stack of papers, away from said discharge opening;

means operably connected to said swing arm for engaging a free end of said swing arm with a top paper in said stack upon movement of said swing arm toward said discharge opening; and means operably connected to said swing arm for disengaging said free end of said swing arm with a top paper in said stack upon movement of said swing arm away from said discharge opening.

2. The permanent wave end paper dispenser of claim 1, further comprising a rubber tip on said free end of said swing arm for frictional engagement with a top paper in said stack.

3. The permanent wave end paper dispenser of claim 1, wherein said free end of said swing arm terminates in a radiused tip.

4. The permanent wave end paper dispenser of claim 1, further comprising an inclined ramp secured to said housing adjacent said discharge opening.

5. The permanent wave end paper dispenser of claim 4, further comprising a notch in said ramp to facilitate grasping of a dispensed paper.

6. The permanent wave end paper dispenser of claim 1, further comprising a mounting block secured to said slider, and means operably connected to said mounting block for moving said slider along said guide track.

7. The permanent wave end paper dispenser of claim 6, wherein said means operably connected to said mounting block for moving said slider along said guide track includes a control rod.

8. The permanent wave end paper dispenser of claim 7, further comprising an elongated slot formed through said mounting block and receiving a free end of said control rod.

9. The permanent wave end paper dispenser of claim 8, further comprising a vertical post;

means rotatably mounting said post in said housing; and mean securing sad post to an end of said control rod opposite said mounting block.

10. The permanent wave end paper dispenser of claim 9, further comprising an axially reciprocal plunger operably connected to said post for rotating said post about a vertical axis.

11. The permanent wave end paper dispenser of claim 10, further comprising spring means biasing said post to a return position.

12. The permanent wave end paper dispenser of claim 10, further comprising a push button mounted on an exterior surface of said housing and operably associated with said plunger for axially moving said plunger.

13. A permanent wave end paper dispenser, comprising:

a housing:

a discharge opening in said housing;

an inclined ramp secured to said housing adjacent said discharge opening;

a notch in said ramp to facilitate grasping of a dispensed paper;

a pepper supply drawer removably received through an opening in said housing and supporting a stack of papers in said housing;

a pivotal swing arm;

a radiused rubber tip on a free end of said swing arm for frictional engagement with a top paper in said stack;

a slider, means pivotally securing said slider to an upper end of said swing arm;

a guide track constraining said slider to reciprocal linear movement and mounting said swing arm for reciprocal sliding movement across said stack of papers, toward and away from said discharge opening;

a mounting block secured to said slider;

a control rod having a free end extending laterally through an elongated slot in said mounting block;

a vertical post;

means mounting said vertical post for rotation within said housing;

mean securing said post to an end of said control rod opposite said mounting block;

an axially reciprocal plunger;

means operably connecting said plunger to said post for rotating said post about a vertical axis;

spring means biasing said post to a return position; and a push button mounted on an exterior surface of said housing and operably associated with said plunger for axially moving said plunger.

* * * * *